US005299100A

United States Patent [19]

Bellows et al.

[11] Patent Number: 5,299,100

[45] Date of Patent: Mar. 29, 1994

[54] MICROWAVE POWERED VEHICLE LAMP

[75] Inventors: Alfred H. Bellows, Wayland; Walter B. Lapatovich, Marlborough, both of Mass.

[73] Assignee: GTE Products Corporation, Danvers, Mass.

[21] Appl. No.: 997,821

[22] Filed: Dec. 29, 1992

[51] Int. Cl.[5] ..... F21M 3/00; F21V 23/00

[52] U.S. Cl. ..... 362/61; 362/263

[58] Field of Search ..... 362/61, 263, 265, 285, 362/382, 457, 458

[56] References Cited

U.S. PATENT DOCUMENTS 5,070,277 12/1991 Lapatovich ..... 315/248

5,113,121 5/1992 Lapatovich et al. ..... 315/248

*Primary Examiner*—Richard R. Cole

*Attorney, Agent, or Firm*—William E. Meyer

[57] ABSTRACT

A microwave vehicle lamp having reflector housing, lens, light source, applicator card, and brace is disclosed. The light source and microwave power applicators are supported by a applicator card, which includes electrical couplings. The card is then adjustablly positioned along one portion in a slot formed in the reflector housing. An adjustable brace may be attached between the reflector housing and the applicator card to finally adjust the light source position for a preferred optical positioning. The brace is then soldered in place to rigidly hold the applicator card in place, yielding a microwave powered vehicle headlamp with a properly and securely positioned light source.

24 Claims, 5 Drawing Sheets

MICROWAVE POWERED VEHICLE LAMP

TECHNICAL FIELD

The invention relates to electric lamps and particularly to vehicle headlamps. More particularly the invention is concerned with a microwave powered vehicle lamp.

BACKGROUND ART

Vehicle lamps, and automotive lamps in particular usually required individual adjustments of the beam pattern with respect to mounting reference points. In sealed beams the filament cannot be lit until after the housing is closed, so the beam adjustment is made by grinding exterior locators to a reference level. With capsule lamps, the reflector housing can be held in an ideal position while the lit capsule is adjusted to its proper optical position. The "lamp-on" adjustment method has the advantage of adjusting both the direction of the beam, and the beam pattern. The "lamp-on" adjustment method generally uses each lamp lead, extended through a respective metal lined eyelet hole in the reflector, to adjust the lamp position. With the lamp in position, the leads are soldered in place in the eyelets, thereby fixing the lamp position.

In a microwave powered lamp, such as disclosed in U.S. Pat. Nos. 5,070,277 and 5,113,121, the lamp assembly includes a printed circuit card that supports the discharge tube, the strip line conductors, and the microwave power applicators. There are no leads, as such, so the old methods of supporting and adjusting the light source do not apply. There is a need for a support structure for the applicator card that prelocates the light source while allowing final, accurate adjustment. In particular, there is need for a structure that limits the complete freedom of the light source to a small range of freedom that is close to the desired position, while still allowing a final accurate positioning. Further, there is a need for a support structure that is compatible with a practical, industrial alignment procedure.

DISCLOSURE OF THE INVENTION

A microwave vehicle lamp may be formed with a reflector housing having a rear wall defining a rearward portion of an enclosed volume, a first reflector coupling point, and a second reflector coupling point. A lens is mated with the reflector housing to substantially close a forward side of the enclosed volume. A substantially planar applicator card having microwave conductive channel for delivering microwave power, a first card coupling point, and a second card coupling point are positioned, so the first reflector coupling point and the first card coupling point are pivotally coupled, and the second reflector coupling point and second card coupling point are rigidly coupled. Means are also included for delivering microwave power to the applicator card, and on to at least one microwave power applicator supported by the applicator card and electrically coupled to the applicator card to receive microwave power from the applicator card, and a microwave powered light source supported from the applicator card, and positioned to receive microwave power from the microwave applicator and thereby produce light.

BEST MODE FOR CARRYING OUT THE INVENTION

Figure 1:
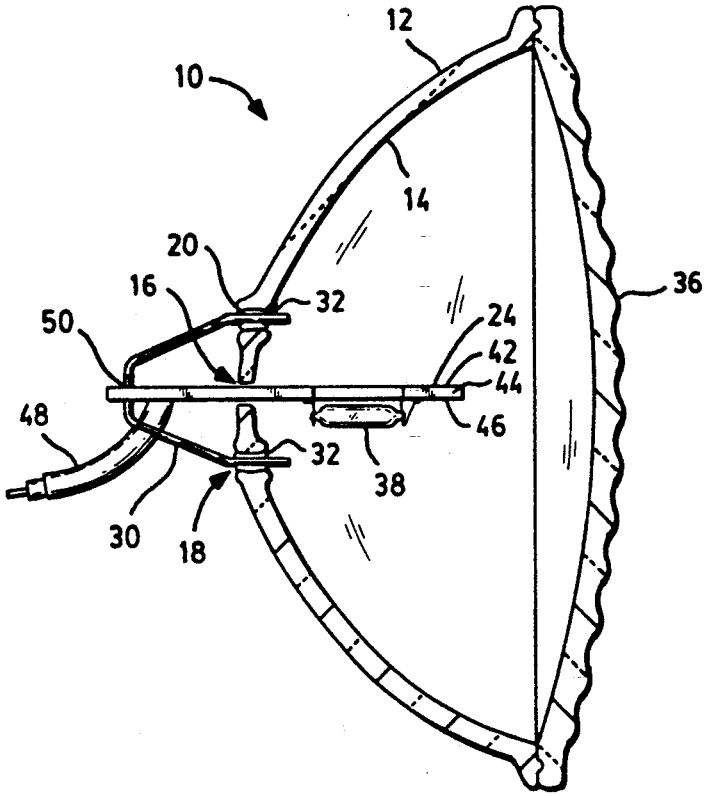
FIG. 1 shows a cross sectional top view of a preferred embodiment of a microwave vehicle lamp.
Figure 2:
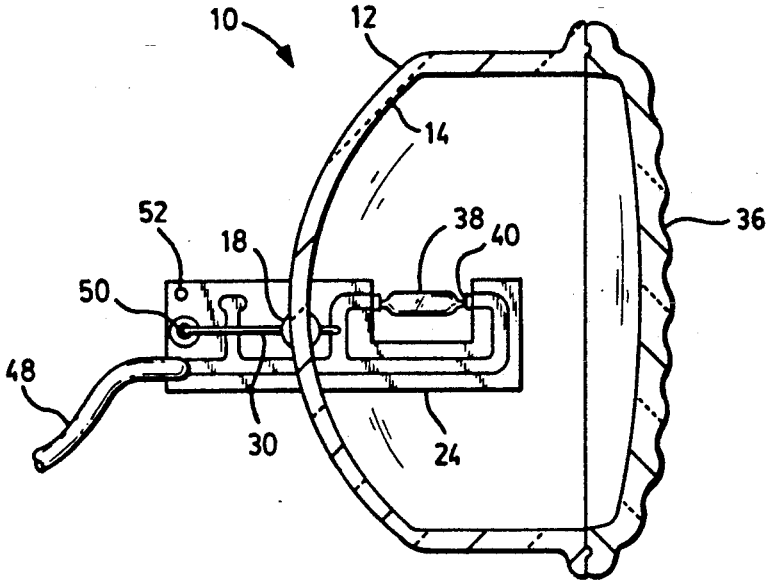
FIG. 2 shows a cross sectional side view of the microwave vehicle lamp in FIG. 1.

FIG. 1 shows a cross sectional top view of a preferred embodiment of a microwave vehicle lamp. FIG. 2 shows a cross sectional side view of the microwave vehicle lamp in FIG. 1. The microwave vehicle lamp 10 is assembled from a reflector housing 12, an applicator card 24, a brace 30, a lens 36, and a light source 38.

The reflector housing 12 may be made out of molded plastic to have the general form of a shell defining an enclosed volume. The reflector housing 12 has a rear wall 14, a first coupling point, which may be a retention slot 16, a second reflector coupling 18, and possibly an optional third reflector coupling 20. The rear wall 14 may include a forward facing reflective surface. Alternatively, the rear wall 14 may be a plane housing wall with a separate reflector positioned in the enclosed volume as is known in the art (not shown). The preferred rear wall 14 includes a reflective section of parabolic surface.

The retention slot 16 is sized and shaped to capture and position a portion of the applicator card 24. The retention slot 16 may comprise a slit passage through the reflector housing 12, having a slit width and length sufficient to admit some or all of the applicator card 24. The preferred retention slot 16 is an open passage through the reflector housing 12, having sufficient clearance to allow the forward portion of the applicator card 24 and light source to be passed through the reflector housing 12 into the enclosed volume. The slot 16 is then a narrow slit formed in the reflector housing 12 to receive a portion of the applicator card 24. The applicator card 24 may be inserted in the slot 16 from either the rear or forward side, as may be convenient.

Figure 6:
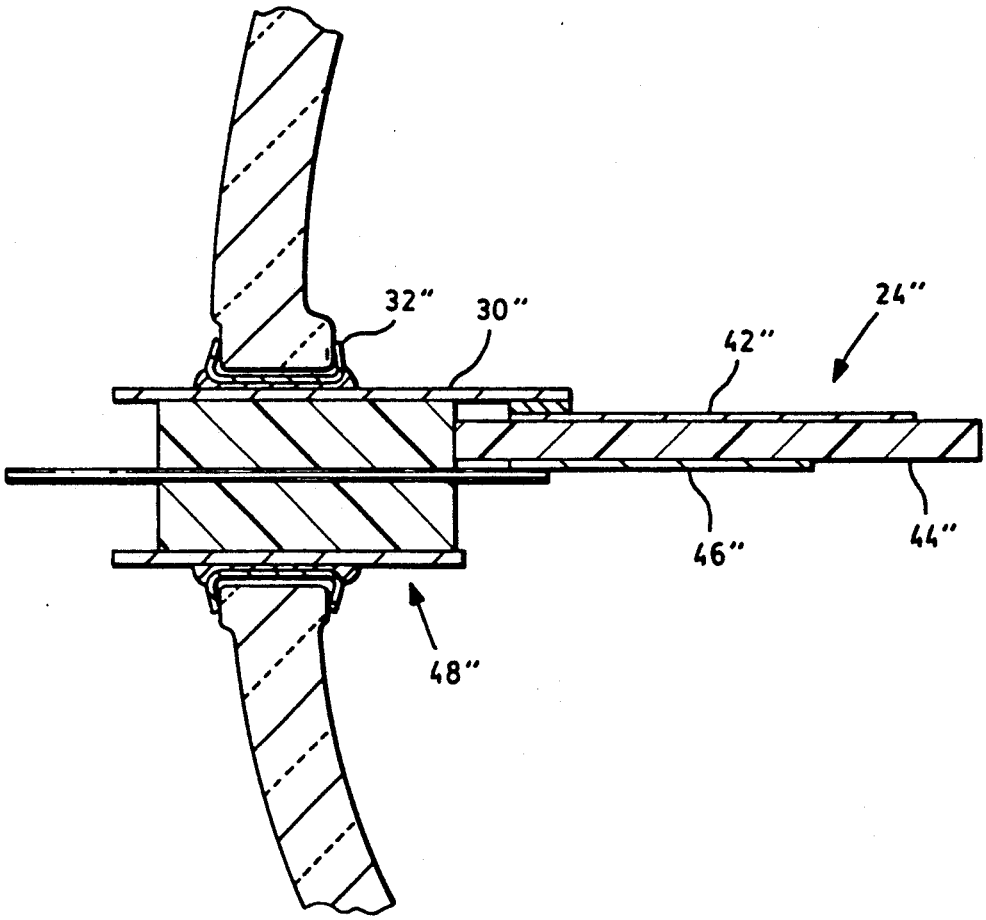
FIG. 6 shows a cross sectional view, partially broken away, of an eyelet coupling, and a coaxial conductor brace coupled to a three layer applicator card.

The reflector housing 12 also includes a second reflector coupling 18. The second reflector coupling 18 comprises a mating point adaptation for coupling the reflector housing 12 to the first end of the brace 30. The preferred second reflector coupling 18 includes a passage in which a portion of the brace 30 may be closely, but adjustablly positioned. In the preferred embodiment, a through hole is formed in the reflector housing 12 and lined with a metal eyelet 32 having sufficient internal diameter 34 to allow a sturdy metal rod to snuggly pass through. The reflector housing 12 may have a second or even a third reflector coupling if needed, all of which may be similarly formed. FIG. 6 shows a cross sectional, detailed view, partially broken away, of a similar eyelet, eyelet 32" coupling, and a similar brace, coaxial conductor brace 30" coupled to a similar three layer applicator card 24".

By way of example reflector housing 12, in FIG. 1, is shown as a parabolic reflector having horizontal truncations along the top and bottom portions. A vertically oriented support slot 16 is located centrally through the rear axis of the reflector housing 12. Horizontally offset on either side of the reflector axis are two metal rivet lined eyelets 32 with through passages. Other suitable cross sectional configuration may be used.

The lens 36 may be made out of glass or plastic to have the general form of a flat or curved surface mateable to the reflector housing 12 to thereby substantially close off the enclosed volume.

The light source 38 may be made from a high temperature and light transmissive material, such as quartz or sapphire, to have the general form of a tubular capsule. The reflector housing 12 and lens 36 enclose the light source 38 in the enclosed volume. The light source 38 may be supported at either or both ends by rods formed to extend from the capsule, with the rods coupling to supports extended from the applicator card 24.

The applicator card 24 may be made out of laminated planar card of conductive and insulative layers to have the general form of a planar card with a notched region 40. The reflector housing 12 encloses at least that portion of the applicator card 24 that supports the light source 38. The preferred applicator card 24 has a notched region 40, a conductive base plane 42 on a first side, an insulative middle layer 44, and a strip line pattern 46 layer on a second side. The notched region 40 may be sized so the light producing portion of the light source 38 may be generally positioned within the notched region 40. The preferred notched region 40 is a rectangular region whose length is longer than the enclosed volume of the light source 38, but shorter than the tip to tip length of the whole light source 38. The width of the preferred light source 38 is less than the width of the notched region 40. Positioned along applicator card 24 may be a conductive base plane 42. The conductive base plane 42 may be a copper layer formed on one side of the applicator card 24. Positioned along applicator card 24 may also be an insulative middle layer 44. The preferred insulative layer 44 is a stiff nonconductive planar piece of plastic, ceramic, or composite. Positioned on applicator card 24 on the side opposite the base plane 42 may be a stripe line pattern 46. The stripe line pattern 46 provides conductive microwave circuit channels for light source 38 power. The applicator card 24 also provides a point of attachment for a microwave power cable 48 and may include filtering components or circuit features, such as those described in U.S. Pat. No. 5,144,206.

The applicator card 24 has a card coupling 50 for the brace 30. The applicator card coupling 50 comprises a mating point adaptation for coupling the applicator card 24 to the first end of the brace 30. The preferred applicator card 24 coupling is similar to the coupling point formed in the reflector housing 12. A through hole may be formed in the applicator card 24 and lined with a metal eyelet 52 having sufficient internal diameter to allow a sturdy metal rod to snuggly pass through. Alternatively the brace 30 may be formed from the power cable 48 as shown in FIGS. 3, 4, 5, 6, 7 and 8.

The brace 30 may be made out of metal to have the general form of a rod. The brace 30 has a first portion that couples to the reflector housing 12. For example, a rod end may be conveniently adjusted and then soldered in metal lined passage, such as an eyelet 32. The brace 30 has a second portion that may be similarly coupled to the applicator card 24. The second rod end may then serve as the second coupling point. The reflector housing 12 couples at the second reflector coupling 18 to the first end of the brace 30. The applicator card 24 may be coupled to the second end of the brace 30. Alternatively, the rod may extend through the applicator card coupling 50 to a second reflector housing 12 coupling 20. By way of example, the brace 30 is shown as a round rod, but rectangular, planar and similarly shaped pieces may be used. It is only necessary that the brace 30 couple between the applicator card 24 and the housing 12, and be sufficiently stiff and durable to adequately retain the reflector housing 12 and applicator card 24 in proper position with respect to each other.

When the applicator card 24 is inserted, a simple U shaped wire brace 30 may be threaded through a hole in the applicator card 24 and as the applicator card 24 is advanced to its final position, the tips of the wire brace 30 are inserted into eyelet holes 18, 20 in the reflector housing. The eyelets hole 50 in the applicator card 24 may be surrounded by a large pad of solderable circuit board conductive coating, typically copper, to thereby receive the soldered connection.

Once inserted to its nominal position, the applicator card 24 positions the discharge tube at a nominal focus position. Manufacturing variations of the various components, particularly of the optical surface, generally require small departures from the nominally ideal optically position to be made to focus and point the beam finally.

Adjustments may be done by hand or by machine as is generally known. Since the applicator card 24 seesaws about a fulcrum point defined by the slot 16, adjustment motions vertically and horizontally are opposite that of the light source 38, while longitudinal motions are in the same direction. The structure then provides a structure that limits the complete freedom of the light source to a small range of freedom that is close to the desired position, while still allowing a final accurate positioning by practical, industrial alignment procedures.

Once the optimal light source 38 position is achieved, the tooling fixture for focusing and aiming the beam maintains the applicator card 24 position for a few seconds while solder is applied to the coupling points along the brace 30. In the embodiment shown in FIG. 1, the first point is at the center of the brace 30, where the brace 30 intersects the applicator card 24. The other points are at the ends of the brace 30 where the brace 30 couples with the reflector housing, 18, 20. When the solder cools, the reflector, applicator card 24 and brace 30 are held in rigid union. The displayed arrangement results in two braces that rigidify the applicator card 24 position. Where the applicator card 24 passes through a slit type slot in the reflector housing 12, a sealant may be applied along the slit to seal the passage into the reflector housing 12. A coaxial connector cable 48 and a protective cover (not shown) may be attached to complete the assembly.

It may be convenient to orient the light source transversely to the reflector axis. Transverse orientation is common in some automotive lamps where the crosswise filament forms a crosswise pattern illuminating the highway. It may also be convenient to position the applicator card entirely in the enclosed lamp volume. Internal positioning is more likely for lamps operated at higher frequency, such as the ISM band centered around 2.45 GHz. For such high frequency lamps, the applicator card may be made much smaller, scaling approximately with the inverse of frequency, thereby permitting the entire applicator card to be mounted inside the reflector housing.

Figure 3:
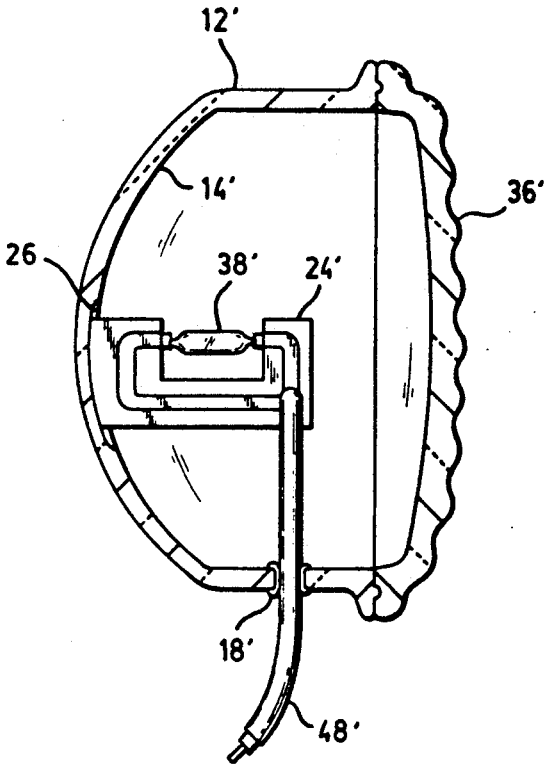
FIG. 3 shows a cross sectional side view of a preferred alternative microwave vehicle lamp.

FIG. 3 shows a cross sectional side view of a preferred alternative microwave vehicle lamp. Similar elements have been numbered correspondingly to those in FIG. 1. Alternatively, the retention slot 16 may be formed as a channel 26' on the interior side of the reflector housing 12', and positioned in the enclosed volume to capture and position an edge of the applicator card 24'. The channel 26' width and depth may be chosen to control the range of motion of the inserted applicator card 24' edge. A narrower, deeper channel 26' limits pivotation of the applicator card 24' to the plane of the channel 26' (normal to the reflector wall). A shallower, broader channel 26' supports less pivotation in the plane of the channel 26', but allows greater pivotation about the channel 26' and transverse to the reflector wall (hinging). FIG. 3 shows a cross sectional side view of a preferred alternative microwave vehicle lamp, where the applicator card 24' is captured in a vertical channel 26' running up the interior of the reflector housing rear wall 14.

Figure 4:
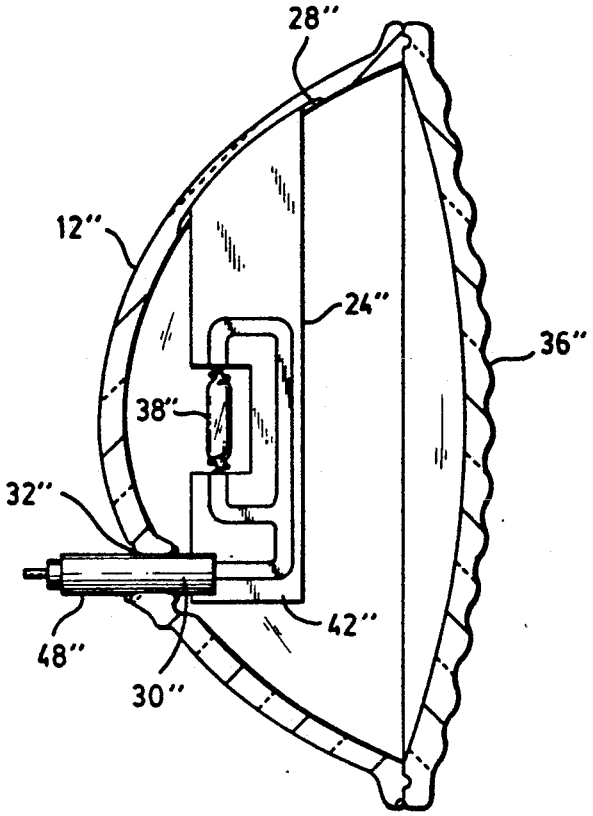
FIG. 4 shows a cross sectional top view of a preferred alternative microwave vehicle lamp.
Figure 5:
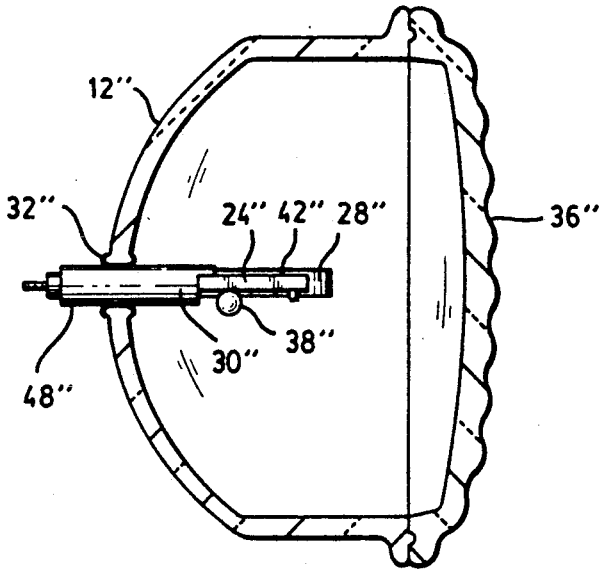
FIG. 5 shows a cross sectional side view of the microwave vehicle lamp in FIG. 4.

FIG. 4 shows a cross sectional top view of a preferred alternative microwave vehicle lamp, where the applicator card 24'' is captured in a horizontal channel 28'' running along the interior side wall of the reflector housing 12''. FIG. 5 shows a cross sectional side view of the microwave vehicle lamp in FIG. 4, showing the light source 38'' position slightly below the applicator card 24''. FIG. 4 shows a headlamp in cross section with the applicator card mounted entirely in the enclosed volume. The applicator card 24'', is positioned on the forward side of the discharge tube 38'' and in a horizontal plane. Forward positioning of the applicator card 24'' minimizes the interference of the light path from the discharge tube 38'' back to the reflector. Any interference with forward going light is thought to have minimal importance, since directly going, forward rays have not been focused or pointed by the reflector. Moreover, it may be useful to block forward going rays that are traveling slightly above horizontal, and thereby shield the eyes of oncoming drivers. The applicator card 24'' is shown with the discharge tube 38'' mounted underneath. The applicator card 24'' can be supported horizontally by positioning an edge of the applicator card 24'' in the horizontal channel 28'', and holding the applicator card 24'' by a coaxial microwave power cable serving also as a brace 30''. The brace 30'' is soldered in place after final adjustment is made to achieve the final position of the applicator card 24'' and discharge tube 38''. An optional second brace may be added for additional stiffness.

FIG. 6 shows the coaxial cable 48'' attached to an edge of the applicator card 24''. The cable 48'' end is shaped so the outer lead is in contact with a first side of the applicator card 24'', the insulative core of the cable 48'' may be braced against the insulative core of the applicator card 24'', and the center lead is connected to a second side of the applicator card 24''. The inner end of the cable 48'' is cut and shaped so the outer lead can be soldered to the base plane 42'' on the upper side of the board while the center lead wire can be soldered to the strip line pattern 46'' on the lower side of the applicator card 24''.

After positional adjustment is completed and the brace, and cable are soldered in place, the coaxial cable 48'' can have a coaxial connector or length of coaxial cable crimped to it for later attachment to the microwave power input supply. Where the power cable 48'' is used as the brace 30, the power coupling structure serves as the applicator card coupling.

Figure 7:
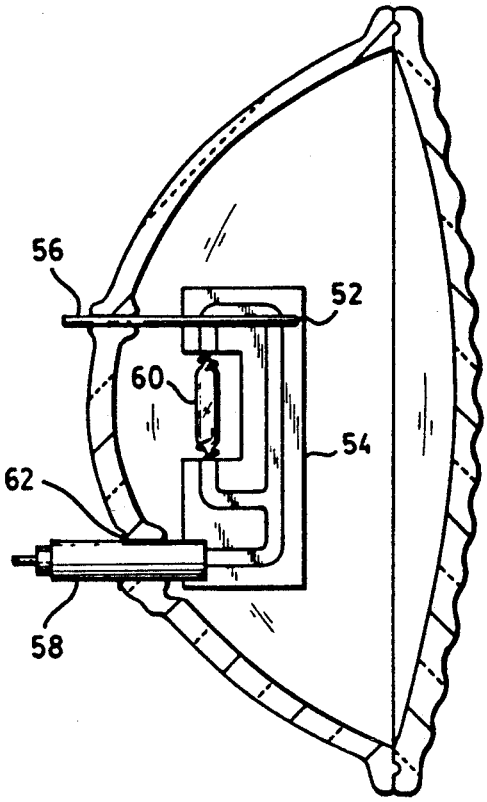
FIG. 7 shows a cross sectional top view of an preferred alternative embodiment of a microwave vehicle lamp.
Figure 8:
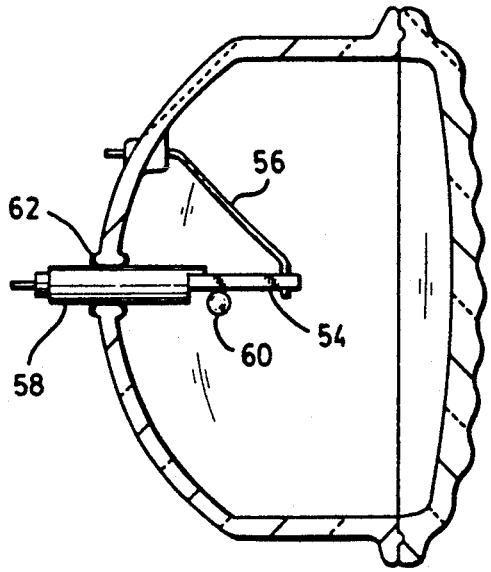
FIG. 8 shows a cross sectional side view of the microwave vehicle lamp in FIG. 7.

FIG. 7 shows a cross sectional top view of an preferred alternative embodiment of a microwave vehicle lamp. FIG. 8 shows a cross sectional side view of the microwave vehicle lamp in FIG. 7. The pivotal connection to the first coupling point 52 on the applicator card 54, may be a rod 56 coupled to a portion of the applicator card 54. The power cable 58 may provide the second, rigid coupling point. A rod 56 coupled to the first applicator coupling point may be sufficiently flexibility, that the applicator card 54 may be coupled to the rod 56 and still be pivoted enough to swing the light source 60 into proper position. The power cable 58 may then be soldered in place to and eyelet 62 to hold the applicator card 54, and light source 60 in the preferred optical position.

In a working example some of the dimensions were approximately as follows: The reflector housing was made of molded plastic, and had a retention slot, a rear wall, a second reflector coupling, with an overall width of about 10 centimeters, a length of about 16.5 centimeters, and a depth of about 6 centimeters. The lens was made of polycarbonate, and had a width of about 10 centimeters, a length of about 16.5 centimeters, and a thickness of abut 2 millimeters. The light source was made of high temperature, light transmissive material, fused silica, and had an inside diameter of about 2.0 millimeters, an outside diameter of about 3.0 millimeters, and a length of about 10 millimeters. The applicator card was made of laminated conductive and insulative layers, and had a notched region, a conductive base plane, a insulative middle layer, a stripe line patterning, a connector coupling, and a power coupling. The applicator card thickness was about 1.52 millimeters (0.06 inch). The brace was made of brass rod, and had a diameter of 1.52 millimeter (0.06 inch). The sample headlamp was self contained, and mounted in an automobile for testing. The color rendition of the light illuminating the roadway was judged to be excellent, and the beam pattern, resulting from simple focusing and adjustment of the applicator card with reference to the reflector was found to achieve adequate distribution. The disclosed operating conditions, dimensions, configurations and embodiments are presented as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A microwave powered vehicle lamp comprising:

a) a reflector housing having a rear wall defining a rearward portion of an enclosed volume, a first reflector coupling point and a second reflector coupling point, b) a lens mated with the reflector housing to substantially close a forward side of the enclosed volume, c) a substantially planar applicator card having microwave conductive channel for delivering microwave power, a first card coupling point, and a second card coupling point wherein the first reflector coupling point and the first card coupling point are pivotally coupled, and the second reflector coupling point and second card coupling point are rigidly coupled by means of a brace, d) means for delivering microwave power to the applicator card, e) at least one microwave power applicator supported by the applicator card and electrically coupled to the applicator card to receive microwave power from the applicator card, and f) a microwave powered light source supported from the applicator card, and positioned to receive microwave power from the microwave applicator and thereby produce light.

2. The lamp in claim 1, wherein the means for delivering microwave power to the applicator card provides the rigid coupling between the second reflector housing coupling point and the second applicator card coupling point.

3. The lamp in claim 1, wherein the reflector housing includes a channel formed on an interior side of the reflector housing, and at least an edge portion of the applicator card is positioned in the channel thereby fixing the edge of the applicator card, while allowing pivotation of the applicator card in the channel in an unbraced state.

4. The lamp in claim 3 wherein the applicator card is positioned in the enclosed volume.

5. The lamp in claim 4, wherein the applicator card is positioned substantially forward of the light source.

6. The lamp in claim 1, wherein the second reflector coupling point includes a passage to closely receive a portion of the brace while the brace position is adjustable along the passage.

7. The lamp in claim 6 where in the passage is defined by a metal wall, the brace portion is a metal piece, and the metal wall and the brace portion are soldered together.

8. The lamp in claim 1, wherein the second card coupling point includes a passage to closely receive a portion of the brace while the brace position is adjustable along the passage.

9. The lamp in claim 8 where in the passage is defined by a metal wall, the brace portion is a metal piece, and the metal wall and the brace portion are soldered together.

10. The lamp in claim 1, wherein the applicator card is includes a notched region within which the light source is substantially positioned across, and the microwave applicator is adjacent.

11. The lamp in claim 1, wherein the applicator card includes a first conductive portion, a second conductive portion, and an intermediate insulative portion.

12. The lamp in claim 11, wherein the brace includes a first lead, a second lead and an intermediate insulative portion, with the first lead electrically connected to the first conductive portion of the applicator card, and the second lead is electrically connected to the second conductive portion, whereby electric power for the applicator card is delivered through the brace.

13. A microwave powered vehicle lamp comprising:

a) a reflector housing having a rear wall defining a rearward portion of an enclosed volume, a retention slot, and a first coupling point, b) a lens mated with the reflector housing to substantially close a forward side of the enclosed volume, c) a substantially planar applicator card having microwave conductive channel for delivering microwave power, and a second coupling point, a portion of the applicator card being closely positioned in the retention slot to be moveable in at least one pivotable direction in an unbraced state, d) a rigid brace coupled along a first portion to the first coupling point, and coupled along a second portion to the second coupling point, securely coupling the reflector housing to the applicator card, and preventing movement of the reflector housing and applicator card with respect to one another in a braced state, e) at least one microwave power applicator supported by the applicator card and electrically coupled to the applicator card to receive microwave power from the applicator card, and f) a microwave powered light source supported from the applicator card, and positioned to receive microwave power from the microwave applicator and thereby produce light.

14. The lamp in claim 13, wherein the reflector housing retention slot is defined by a through slit having the dimensions of an end projection of at least a portion of the applicator card, and at least a portion of the applicator card is inserted through the slit.

15. The lamp in claim 14, wherein the brace includes a first lead, a second lead and an intermediate insulative portion, with the first lead electrically connected to the first conductive portion of the applicator card, and the second lead is electrically connected to the second conductive portion, whereby electric power for the applicator card is delivered through the brace.

16. The lamp in claim 13, wherein the reflector housing includes a channel formed on an interior side of the reflector housing, and at least an edge portion of the applicator card is positioned in the channel thereby fixing the edge of the applicator card, while allowing pivotation of the applicator card in the channel in an unbraced state.

17. The lamp in claim 16, wherein the applicator card is positioned in the enclosed volume.

18. The lamp in claim 17, wherein the applicator card is positioned substantially forward of the light source.

19. The lamp in claim 13, wherein the first coupling point includes a first passage to closely receive a portion of the brace while the brace position is adjustable along the first passage.

20. The lamp in claim 19 where in the first passage is defined by a metal wall, the first brace portion is a metal piece, and the metal wall and first brace portion are soldered together.

21. The lamp in claim 13, wherein the second coupling point includes a second passage to closely receive a portion of the brace while the brace position is adjustable along the second passage.

22. The lamp in claim 21, where in the second passage is defined by a metal wall, the second brace portion is a metal piece, and the metal wall and second brace portion are soldered together.

23. The lamp in claim 13, wherein the applicator card includes a notched region within which the light source is substantially positioned across, and the microwave applicator is adjacent.

24. The lamp in claim 13, wherein the applicator card includes a first conductive portion, a second conductive portion, and an intermediate insulative portion.

* * * * *